United States Patent [19]

Ericson et al.

[11] Patent Number: 4,848,519

[45] Date of Patent: Jul. 18, 1989

[54] STRUCTURAL SUPPORT FOR HYDRAULIC ELEVATOR CAR

[75] Inventors: Richard J. Ericson, Southington; Jaime A. Rivera, Bristol, both of Conn.

[73] Assignee: Otis Elevator Company, Farmington, Conn.

[21] Appl. No.: 686,177

[22] Filed: Dec. 24, 1984

[51] Int. Cl.[4] ..... B66B 9/00

[52] U.S. Cl. ..... 187/1 R; 187/17; 254/89 H

[58] Field of Search ..... 187/1 R, 17, 67, 95, 187/2, 8.59; 254/89 H, 89 R, 93 R

[56] References Cited

U.S. PATENT DOCUMENTS

| | | | |
|---|---|---|---|
| 2,214,588 | 9/1940 | Lagerquist et al. | 187/17 |
| 3,536,161 | 10/1970 | Clarke | 187/8.59 |
| 3,613,834 | 10/1971 | Field | 187/17 |
| 3,632,088 | 1/1972 | Filipek | 254/89 H |
| 4,063,619 | 12/1977 | Drews | 187/1 R |
| 4,155,425 | 5/1979 | Allen et al. | 187/17 |
| 4,502,569 | 5/1985 | Loechner | 187/17 |

FOREIGN PATENT DOCUMENTS

| | | | |
|---|---|---|---|
| 1215579 | 4/1960 | France | 254/89 H |

*Primary Examiner*—Joseph J. Rolla
*Assistant Examiner*—Kenneth Noland

[57] ABSTRACT

An hydraulic elevator (10) is powered by a pair of jacks (45) disposed adjacent to opposite sides of the platform (40) of the elevator car at medial locations thereon for enhanced compactness of the elevator and generally symmetric, nonbending support of the car.

5 Claims, 3 Drawing Sheets

STRUCTURAL SUPPORT FOR HYDRAULIC ELEVATOR CAR

DESCRIPTION

This patent is being filed on even date with U.S. patent application Ser. No. 686,183 entitled HOLELESS HYDRAULIC ELEVATOR WITH IMPROVED CAR FRAME, U.S. patent application Ser. No. 686,181 entitled IMPROVEMENTS IN HYDRAULIC ELEVATOR JACK and U.S. patent application Ser. No. 686,182 entitled IMPROVED GUIDE SYSTEM IN AN HYDRAULIC ELEVATOR, all assigned to the assignee of the present invention.

1. Technical Field

This invention relates to elevators and particularly to holeless, hydraulic elevators.

2. Background Art

Short rise hydraulic elevators are well known in the art. Certain of such elevators comprise a car powered vertically by an hydraulic jack exposed beneath the elevator car in a hole beneath the hoistway. Provision of such a hole to accommodate the jack represents a significant portion of the cost of the erection of such an hydraulic elevator. In an effort to reduce the construction costs associated with such prior art elevators, holeless hydraulic elevators have been developed. In such a holeless elevator the car is powered by one or more hydraulic jacks, the cylinders of which are disposed generally alongside the car rather than beneath it, the lower ends of the jacks being received within a shallow pit at the bottom of the hoistway rather than in a deeper hole as described hereinabove. While the elimination of holes in hydraulic elevators has reduced the construction costs thereof, it has been determined that state of the art holeless hydraulic elevators still exhibit various shortcomings.

A number of such shortcomings in present day holeless hydraulic elevators are associated with the elevator car frame which in some instances employs at the sides thereof, compressively loaded uprights with diagonal braces connected between the uprights and the car platform. It has been found that such car frames are not only complex, requiring rod fixtures on both the upright and car platform as well as means for adjusting rod tension, but are quite heavy as well. Moreover, in such a frame structure, various components of the frame tend to be loaded in compression and bending which adversely affect the stability of the car under operating conditions and require accommodation by heavy structural members thereby further contributing to the weight of the frame. Such car frames also tend to militate against ease of serviceability of the jacks since the upright is often in a position which interferes with maintenance on the jack disposed adjacent thereto.

Prior art hydraulic elevators also exhibit various deficiencies in the support and stabilization of the car by the jacks and guide rails employed therein. Most of such deficiencies are attributable to the somewhat common approach of asymmetric support of the car by the jacks wherein, the jacks support the car by connection to the sides of the car frame either forwardly or rearwardly of the center thereof. Thus, the weight of the car applies bending moments to the jacks and guide rails, thereby requiring burying of the lower ends of the jacks within the ground with an attendant risk galvanic corrosion of the jack cylinders as well as requiring heavy rails which add to the expense to the elevator in the cost of both materials therefor and erection thereof. Moreover, prior art hydraulic elevators often fail to provide adequate yet economical means for limiting the overtravel of the elevator car (due to, for example, a malfunction of the hydraulic control system) while dissipating the kinetic energy of the car during such overtravel conditions.

The above deficiencies associated with prior art hydraulic elevators combined with the desirability of mechanically simplifying such elevators while at the same time reducing the weight thereof has lead to the present invention.

DISCLOSURE OF INVENTION

It is therefore an object of the present invention to provide an hydraulic elevator of enhanced simplicity and stability and which is light in weight.

It is another object of the present invention to provide an hydraulic elevator which is compact and easily serviceable.

It is another object of the present invention to provide an hydraulic elevator characterized by an enhanced ease in the erection thereof.

It is another object of the present invention to provide an hydraulic elevator wherein overtravel of the elevator car due to malfunction of the hydraulic system is safely and simply limited.

In accordance with the present invention, the car of an hydraulic elevator is powered by a pair of hydraulic jacks disposed adjacent to the platform of the car at medial locations on opposed sides of the platform and received interiorly of side portions of the car frame for enhanced compactness of said elevator and generally symmetric, nonbending support of the car. The elevator also includes at least one guide rail laterally displaced from, and generally parallel to a corresponding one of the jacks and a mounting bracket by which the guide rail and jack are simultaneously secured to the elevator hoistway and mutually aligned. In accordance with another aspect of the present invention, the elevator jacks at base portions thereof, are received within an upwardly open jack base by which the jacks are aligned simultaneously with the erection thereof. The jacks are vertically unrestrained within the jack base thereby allowing the elevator to "jump" upwardly to dissipate the kinetic energy associated with upward overtravel of the car.

BEST MODE FOR CARRYING OUT THE INVENTION AND INDUSTRIAL APPLICABILITY THEREOF

Figure 1:
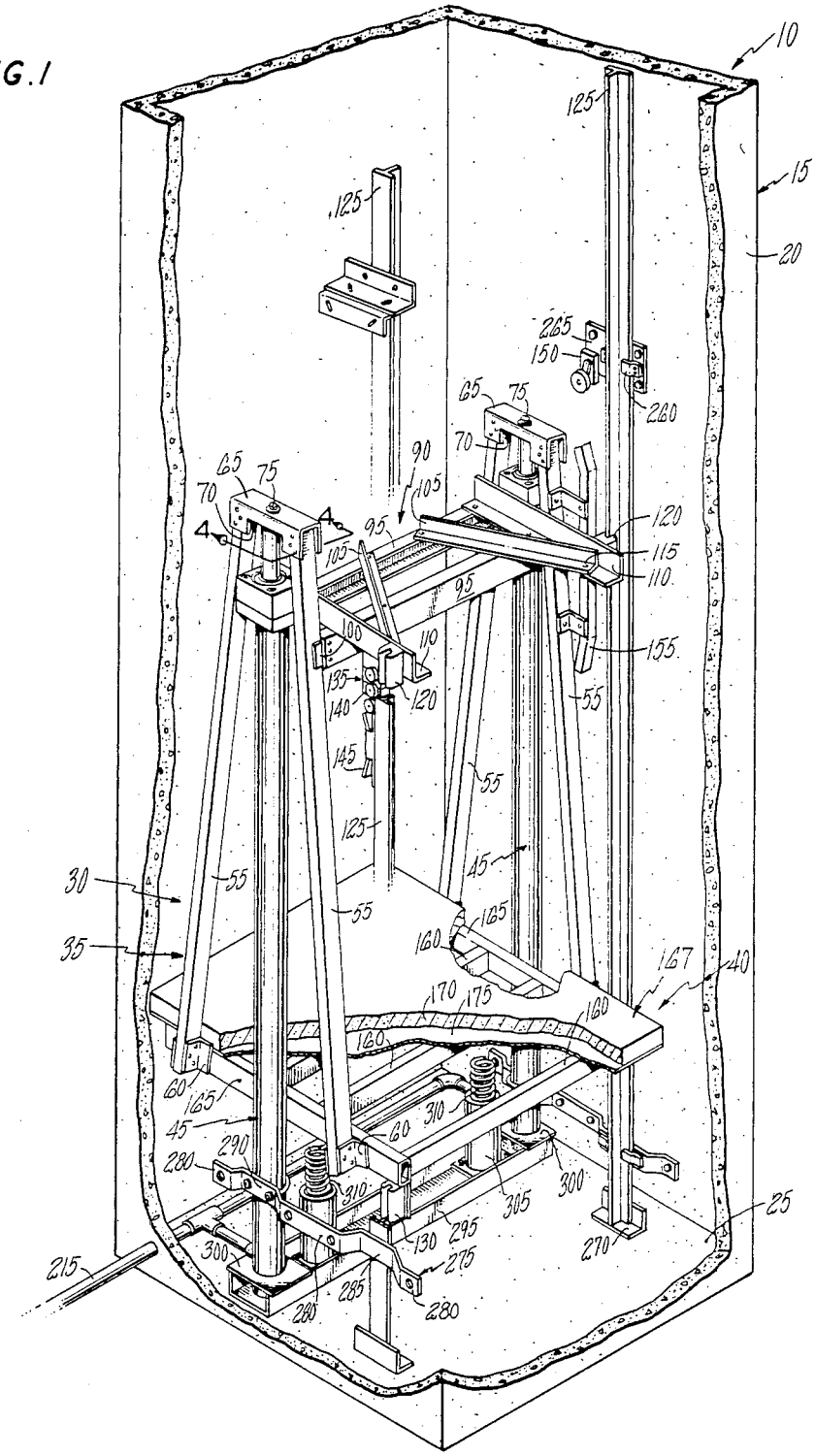
FIG. 1 is an isometric view of a preferred embodiment of the hydraulic elevator of the present invention, portions of the elevator being either broken away or, removed entirely to show details of the construction thereof.

Referring to FIG. 1, an hydraulic elevator 10 is disposed within a hoistway 15 including a sidewall structure 20 and a lower pit 25. The elevator itself comprises a car 30 including a frame 35, a sidewall structure (which for clarity is not illustrated) and a platform 40. The car is powered by a pair of upright jacks 45 disposed on opposite sides of the car and supported within hoistway 15 on the floor of pit 25.

Figure 4:
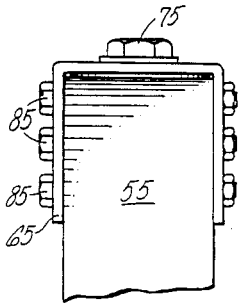
FIG. 4 is an enlarged, fragmentary, elevation of the connection between one of the braces employed in the frame of the elevator car and the output member of the hydraulic jack and taken in the direction of line 4—4 of FIG. 1.

Car frame 35 comprises a pair of opposed side frame sling assemblies each including a pair of oblique upwardly convergent braces 55 fixed at lower ends thereof to the car platform at opposed sides thereof. The braces may be of any known structural shape, in the preferred embodiment the braces being formed from tubular steel for strength and lightness. The lower ends of the braces are attached to the platform by riveted, bolted, or similar connections to L-shaped brackets 60 welded or similarly attached to the sides of the platform. The upper ends of the braces are connected together by a rigidly bolted or riveted connection to opposite ends of bracket 65 of generally U-shaped cross section, the sides of bracket 65 each including a cutout 70 which accommodates the head of jack 45 therewithin. The connection between braces 55 and bracket 65 is shown in greater detail in FIG. 4. As shown therein, each brace is received within the interior of the bracket outwardly of the medial portion thereof which is connected by bolt 75 to the jack. As illustrated, three bolts 85 pass through both sides of the bracket and each brace although greater or lesser numbers of fasteners may be employed depending upon the capacity of the elevator, the weight of the car and other relevant factors. As best seen in FIG. 1, bracket 65 serves to provide a connection between the jack and the car frame, and it will thus be appreciated that the connections between bracket 65 and braces 55 are loaded by the weight of the car. However, the tubular shape of the braces and the U-shaped cross section of bracket 65 cause each of bolts 85 to be loaded in double shear for enhancing the strength of the connection. Furthermore, it will be appreciated that braces 55 are loaded entirely in tension which enhances the stability of the car and eliminates any need for more massive structural components required to accommodate compressive and/or bending modes of loading.

Referring again to FIG. 1, the side frame assemblies are connected together by a cross head 90 comprising a pair of generally parallel channel members 95 connected by bolts, rivets or the like at opposite ends thereof to inwardly extending plates 100 attached to braces 55 by a welded or similar connections thereto. Channels 95 support oblique brackets 105 and lateral brackets 110 by bolted, riveted or similar connections thereto, brackets 105 and 110 being connected together at 115 by bolts, rivets or the like. As illustrated, each lateral bracket 110 carries an upper guide shoe 120 which slideably engages a corresponding guide rail 125 of generally T-shaped cross section which is mounted to a sidewall of the hoistway. Those skilled in the art will, of course, recognize that the engagement of upper guide shoes 120 as well as lower guide shoes 130 (carried by the car frame at the bottom of the platform thereof) with guide rails 125 provides additional lateral stability to the car. It will be seen that brackets 110 function not only as mounts for the guide shoes but also as mounts for leveling switch 135 including rollers 140 operated by stationary cams 245 mounted on the guide rail. Those skilled in the art will, of course, readily appreciate that leveling switch 135 operated by cam 145 along with leveling switch 150 operated by cam 155 attached to the opposite side frame assembly controls hydraulic fluid flow to and from the jacks for controlling such functions as acceleration and deceleration of the car by the jacks. Bracket 110 in providing a mount for both guide shoe 120 and leveling switch 135 simplifies the overall structure of the car frame by eliminating the need for separate mounts for these components.

Platform 40 comprises a generally planar array of tubular beams including a plurality of parallel beams 160 joined at opposite ends thereof (as by welding or the like) by a pair of generally parallel beams 165 orthogonally disposed with respect to beams 160. The platform includes a floor portion 167 overlying the platform frame and mounted thereto as by screws (not shown) or the like, the floor portion comprises a laminar arrangement of a lightweight, structural upper plate 170 formed from such material as wood, composite, or an oriented strand wood fiber material such as that sold by Weyerhaeuser Company under the mark Structurwood and a metallic lower plate 175 functioning as a fire stop and typically formed from aluminum, sheet steel, or the like. Such a platform structure, employing a planar array of tubular beams and a lightweight floor, substantially reduces the weight of the platform as compared to the platforms of prior art elevators thereby reducing the required strength and thus the weight of the remainder of the car frame as well as the hydraulic requirements of the elevator.

Figure 2:
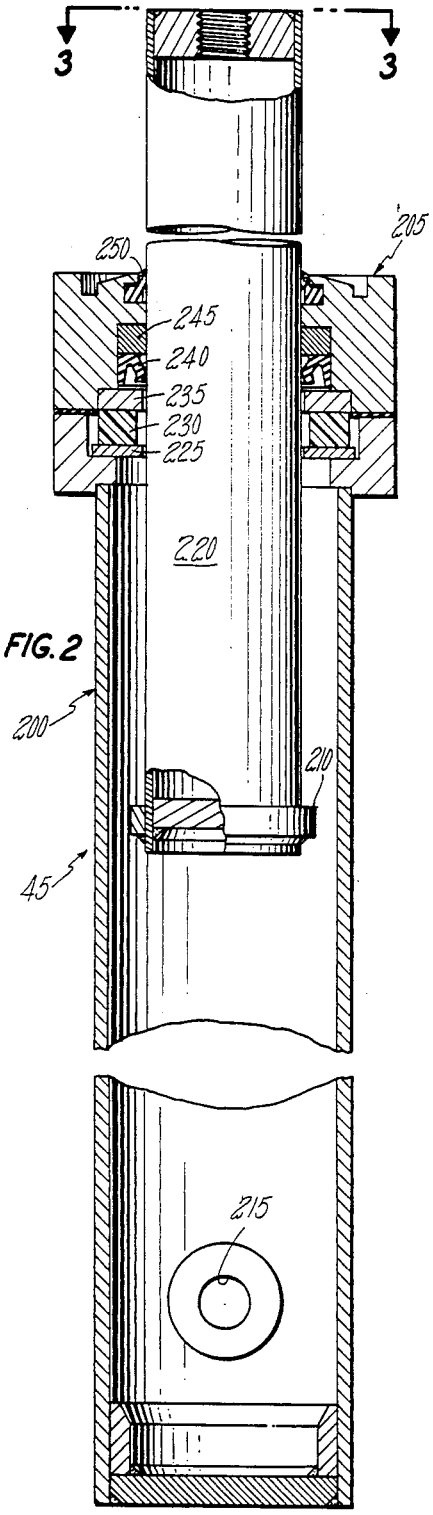
FIG. 2 is a side elevation in partial section of one of the hydraulic jacks employed with the elevator of the present invention.
Figure 3:
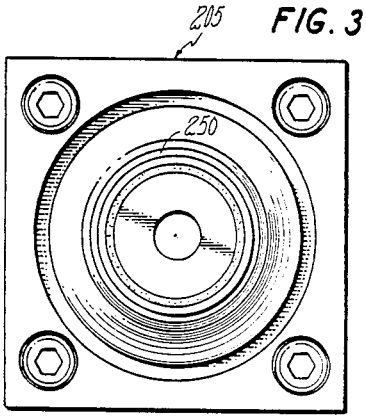
FIG. 3 is a view taken in the direction of line 3—3 of FIG. 2.

Referring to FIG. 2, each of jacks 45 comprises a cylinder 200 including a head 205 defined by housing members 207 and 208 and a plunger 210 disposed within the cylinder for reciprocal movement with respect thereto in response to changes in pressurization and draining of the cylinder with hydraulic fluid through hydraulic lines 215. Plunger 210 is mounted on connecting rod 220 which extends outwardly of cylinder 200 through the head, the upper end of rod 220 including a hole through which bolt 75 is threaded for connecting the rod to bracket 65.

As set forth hereinabove, in the event of a malfunction of the hydraulic control system it is desirable to provide hydraulic elevators with means to limit overtravel of the car while safely dissipating the kinetic energy of the car associated with any such overtravel. In accordance with the present invention, jack 45 is provided with stop means disposed proximally to the cylinder head for limiting overtravel of the plunger while dissipating the kinetic energy thereof and means associated with the plunger for abutment with the stop means. As best illustrated in FIG. 2, the stop means comprises a hard impact ring 225 of steel or the like backed by a resilient urethane ring 230 which is in turn backed by a hard stop ring 235. In the event that plunger 210 is caused to overtravel upwardly due to an hydraulic system malfunction, the plunger will abut impact ring 225 which upwardly compresses urethane ring 230 against stop ring 235, thereby eliminating further plunger overtravel and dissipating the energy of such overtravel by compression of the urethane ring to reduce the risk of damage to the jack. Head 220 also accommodates a rubber seal 240, a wear ring 245 and wiper 250 in the usual manner. It will be noted that since the jack is received interiorly of the oblique braces 55 and since the guide rails are laterally offset from the jack, the jack is readily accessable for ease in maintenance thereof. Moreover, the lack of interference with the jack by the car frame and guide rails allows large clearances for head 205 and thus, the convenient accommodation of the two rectangular housing members 207 and 208 bolted together at the corners thereof with four bolts 255. This is to be contrasted with various prior art elevator jack designs wherein jack head clearances are so limited that the head must be cylindrical in shape and of a diameter requiring bolting with as many as 9 to 12 bolts making such a head costly to manufacture and difficult to service.

Referring again to FIG. 1, as illustrated therein, jacks 45 are disposed adjacent to the car platform at medial locations on opposed sides thereof whereby the car is supported in a generally symmetric manner thereby reducing rail reactions to loading thereof and allowing rails of lighter weight than those of the past to be used. Disposition of the jacks interiorly of the car frame side assemblies (between oblique braces 55) not only renders the jacks easily serviceable, but provides a more efficient use of the interior of the hoistway.

Guide rails 125 are mounted at the upper portions thereof to the hoistway walls with clamps 260 carried by fixtures 265 bolted to the hoistway walls and at the lower ends thereof by fastening (such as by welding) to angle brackets 270 mounted to the floor of the pit by any suitable means such as bolts and the like (not shown). The guide rails and jacks are also fixed to the hoistway walls and aligned with each other by connection to mounting brackets 275 each comprising a plurality of spaced feet 280 at which the bracket is secured to the hoistway sidewalls as by bolting. As shown, the bracket is a unitary structure in which the feet 280 alternate with fixture portions (lands) 285 and 290 at which jack and guide rail, respectively, are connected to the bracket as by clamping. Since the car is symmetrically supported by the jacks, the jacks are generally symmetrically loaded and therefore, the prior art practice of burying the lower ends of the jacks to accommodate bending loads thereon is unnecessary. Accordingly, the lower ends or bases of the jacks are received within a jack base comprising an upwardly open, generally U-shaped channel member 295 closed at the ends thereof with closure plates 300 fastened thereto such as by welding, the closure plates being apertured to receive the jack bases for the alignment and vertically unrestrained accommodation thereof within the channel member. Such vertically, unrestrained accommodation allows the jacks to freely "jump" upwardly in the event of overtravel of the car for further dissipation of the kinetic energy associated therewith. The jack base also provides a convenient mount for receptacles 305 which accommodate buffer springs 310 on which the platform may rest when lowered. The receptacles are fixed to the web of the channel member by any suitable means such as bolts or the like.

Figure 6:
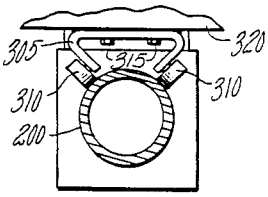
FIG. 6 is a top plan view in partial section of a portion of the car frame a guide shoe carried thereby, and an associated hydraulic jack, taken along line 6—6 of FIG. 5.
Figure 5:
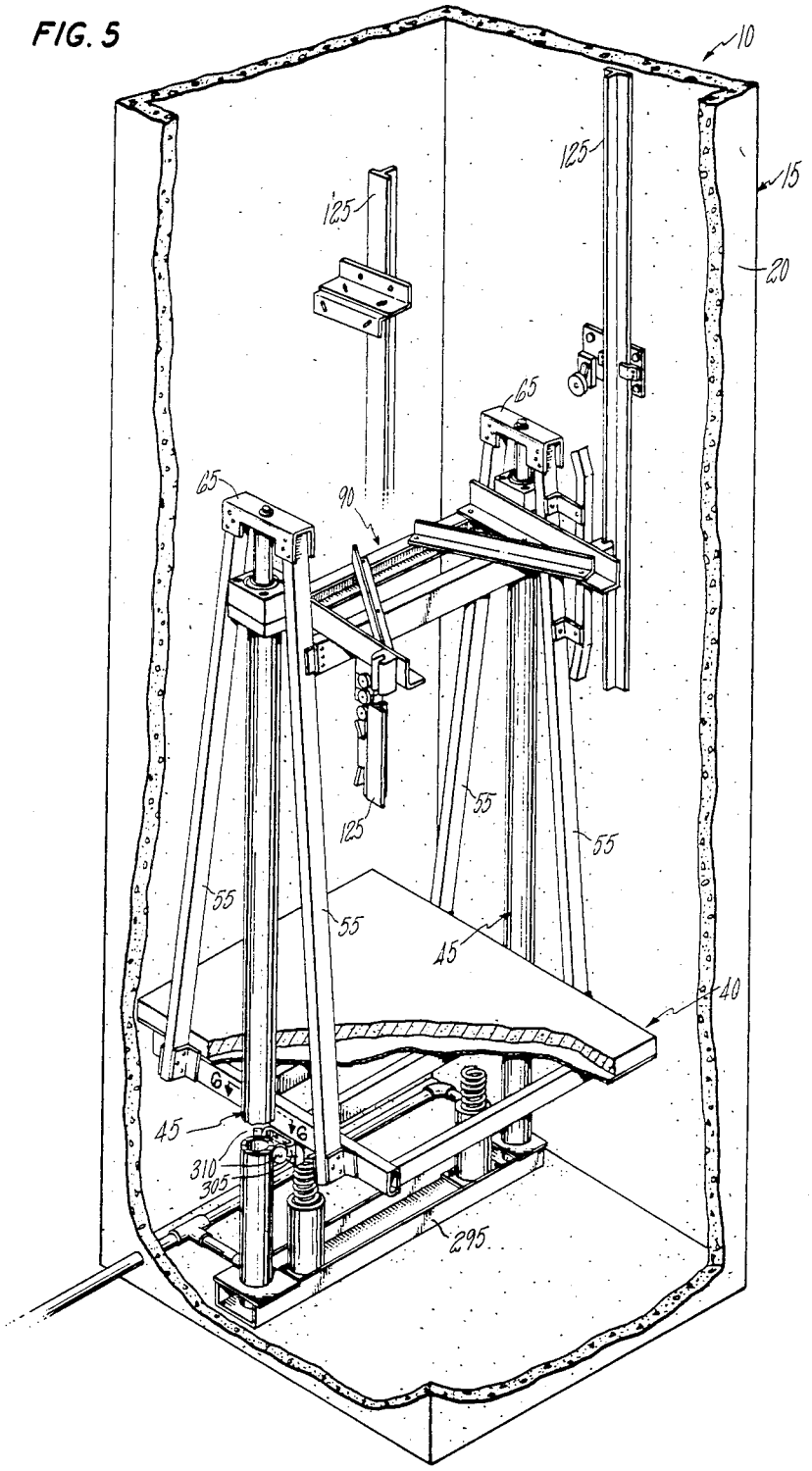
FIG. 5 is an isometric view similar to FIG. 1, but showing an alternate embodiment of the hydraulic elevator in which lower portions of the guide rails thereof have been eliminated.

Referring to FIGS. 5 and 6, an alternate embodiment of the elevator is shown. In this embodiment the lower portions of guide rails 125 have been eliminated, the jack cylinders taking the place of the lower rail portions and the lower slotted guide shoes have been replaced by a guide shoe 300 comprising a U-shaped bracket 305 carrying rollers 310 at the ends thereof. Bracket 305 is bolted at 315 to a mounting member 320 at the bottom of the car platform in alignment with jack cylinders 200 so that rollers 310 engage the cylinder walls. Thus, with this arrangement, lateral stability of the car at lower positions thereof is attained by movement of the car along the jack cylinders without necessitating lower guide rails, thereby further simplifying the elevator and rendering the elevator more economical in both material and assembly costs thereof.

From the foregoing, it will be seen then that the car frame described herein is simpler than prior art frames since it requires neither adjustable rods nor upright members. The frame is more stable than prior art frames since the side supports are loaded in tension, without any significant compressive or bending loads thereon and the joints are rigid. Since the jacks are generally coplanar with the side frame assemblies, the elevator is compact and the jacks are easily serviceable. The tubular frame floor further contributes to the lightness of the elevator and the symmetric support of the car frame by the centrally disposed jacks allows the use of smaller rails, due to minimal rail reactions. The symmetric loading of the jacks also eliminates the need to bury the lower ends of the jacks thus eliminating the risk of the galvanic corrosion of the jack ends due to such burial. Furthermore, since the jacks do not require burying, they may rest on the pit floor in a vertically unrestrained orientation allowing the entire elevator to "jump" in the event of car overtravel thereby contributing with the novel jack head structure to the elevator's ability to dissipate the kinetic energy associated with upward overtravel of the car. The integral guide shoe and leveling switch mounting, the one piece rail jack bracket and the jack base further simplify the manufacture and erection of the elevator.

It should be understood that the invention is not limited to the particular embodiments shown and described herein, but that various changes and modifications may be made without departing from the spirit and scope of the invention as defined by the following claims.

Having thus described the invention, what is claimed is:

1. In an elevator comprising a car powered within a hoistway by a pair of generally parallel hydraulic jacks, each including a base portion and an output member having a free upper end portion, said car comprising a car frame including a platform and a pair of opposed side frame sling assemblies fixed thereto and upstanding therefrom, the improvement characterized by:

substantially the entire weight of said platform being supported tensely by said side frame sling assemblies;

said hydraulic jacks being disposed adjacent to said platform at medial locations on opposed sides thereof, and received interiorly of, and attached to said car frame only at upper portions of said side frame sling assemblies substantially entirely in coplanar relationship thereto at said free upper end portions of said output members for enhanced compactness of said elevator and hoistway, as well as generally symmetric, nonbending loading of said car frame and jacks;

at least one guide rail along which said car is movable for imparting lateral stability to said car, said guide rail being laterally displaced from, and generally parallel to a corresponding one of said jacks;

at least one mounting bracket for said guide rail and corresponding jack, said mounting bracket being attachable to a wall of said hoistway and including;

first and second laterally spaced mounting bracket fixtures to which said jacks and a corresponding guide rail, respectively, are fixed for alignment of said jack and guide rail simultaneously with the erection thereof;

each of said mounting brackets including a plurality of spaced feet at which said bracket is secured to said hoistway wall; and said fixtures comprising a pair of raised lands to which said jack and guide rail are clamped.

2. The elevator of claim 1 characterized by said bracket comprising a unitary structure in which said feet alternate with said fixtures.

3. The elevator of claim 2 characterized by said jack base comprising an upwardly open, generally U-shaped channel member, said fixtures comprising upper closure plates fixed to said channel member at spaced location thereon, said closure plates being apertured to receive therethrough, the base portions of said jacks for the vertically, unrestrained accommodation thereof within said channel for enhanced dissipation of the kinetic energy associated with upward overtravel of said car.

4. The elevator of claim 3 characterized by said buffers including at least in part coil springs and said buffer fixtures comprising receptacles for said coil springs fixed to the web portion of said channel member.

5. The elevator of claim 1 characterized by:

a jack base disposed beneath said car and including first and second spaced jack fixtures accommodating the lower ends of said jacks for the mutual alignment of said jacks simultaneously with the erection thereof; and first and second buffers providing selective compliant support for said car in a lowered position thereof; and said jack base comprising an upwardly open, generally U-shaped channel member, including first and second buffer fixtures disposed within said channel member inwardly of, and proximal to said jack fixtures for the alignment of said buffers with said jacks simultaneously with the erection thereof.

* * * * *